US006786123B1

(12) United States Patent
Chen

(10) Patent No.: US 6,786,123 B1
(45) Date of Patent: Sep. 7, 2004

(54) PORTABLE PRECISION CUTTING DEVICE

(76) Inventor: Chieh-Tang Chen, No. 6, Ming De St., Hua Tan Hsiang, Chang Hua Hsien (TW)

( * ) Notice: Subject to any disclaimer, the term of this patent is extended or adjusted under 35 U.S.C. 154(b) by 39 days.

(21) Appl. No.: 10/406,905

(22) Filed: Apr. 3, 2003

(51) Int. Cl.[7] ..... B26D 1/18
(52) U.S. Cl. ..... 83/485; 83/614; 83/564
(58) Field of Search ..... 83/614, 485, 455, 83/564, 578, 582, 489

(56) References Cited

U.S. PATENT DOCUMENTS 3,187,616 A * 6/1965 Bitter ..... 83/462
3,949,629 A * 4/1976 Johnson ..... 83/27
4,871,156 A * 10/1989 Kozyrski et al. ..... 269/303
5,069,097 A * 12/1991 Mori ..... 83/56
5,322,001 A * 6/1994 Boda ..... 83/485
5,524,515 A * 6/1996 Boda ..... 83/455
5,802,942 A * 9/1998 Cornell et al. ..... 83/455
5,996,459 A * 12/1999 Cornell et al. ..... 83/485
6,098,515 A * 8/2000 Daley, Jr. ..... 83/485
6,460,443 B1 * 10/2002 Hsiao ..... 83/614

* cited by examiner

*Primary Examiner*—Boyer D. Ashley
(74) *Attorney, Agent, or Firm*—Charles E. Baxley

(57) ABSTRACT

A portable precision cutting device comprises a cutting board, cutting-resistant pad, a pressing member and a cutting mechanism. The cutting mechanism is movably located at the pressing member. The pressing member is attachable to the cutting board. The cutting mechanism is provided with a roller blade and a shield at a side, an edge of the cutting board is in form of an inclined surface.

5 Claims, 6 Drawing Sheets

PORTABLE PRECISION CUTTING DEVICE

BACKGROUND OF THE INVENTION

1. Field of the Invention

The present invention relates to a cutting device, and more particularly to a portable precision cutting device for cutting objects (such as paper) in piles.

2. Description of the Prior Arts

Normally, a conventional cutting device provided for cutting objects (linear cutting) in piles (such as plastic films, photos, paper sheets and likes) is a cutting pad device including a knife mounted to an end of a cutting pad. In real operation, however, the conventional cutting pad device still has some disadvantages as follows:

First, a knife of the conventional cutting device is not sharp enough, thereby the cutting edge of the objects to be cut will not be in is level and smooth (lightly zigzag), which is not up to a precision cutting standard.

Second, the conventional cutting device has an end of the knife mounted to the cutting pad and another end hold by a user so as to make a cutting. It is to be noted that the cutting force of the knife acting on the objects to be cut differs from the different part of the knife, viz. unbalanced, so that the cutting edge will not be level and smooth and will result in high rate of failure (particularly in case of a plenty of paper sheets to be cut).

Third, the operation of the conventional cutting pad device is initialed by lifting the knife and followed by compressing it onto the objects to be cut, so it should be very careful during operation, otherwise, accident may be happened. Furthermore, the knife should be compressed down for purpose of returning to original position, otherwise, it maybe hurt the users by a cut of falling down because of the gravity of itself.

Fourth, the conventional cutting device is big in volume and heavy in weight, which is not light and handy nor applicable to precision cutting.

The present invention has arisen to mitigate and/or obviate the afore-described disadvantages of the conventional cutting device.

SUMMARY OF THE INVENTION

In accordance with one aspect of the present invention, there is provided a portable precision cutting device which comprises a cutting board, a cutting-resistant pad, a pressing member, and a cutting mechanism. The cutting mechanism is movably located at the pressing member. The pressing member is attachable to the cutting board.

The primary objective of the present invention is to provide a portable precision cutting device, which is applicable to a precision linear cutting operation and the cutting edge of the sheets to be cut is level and smooth, furthermore, the cutting device in accordance with the present invention is light and handy, and the cutting mechanism having a safe structure for protecting the operators.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
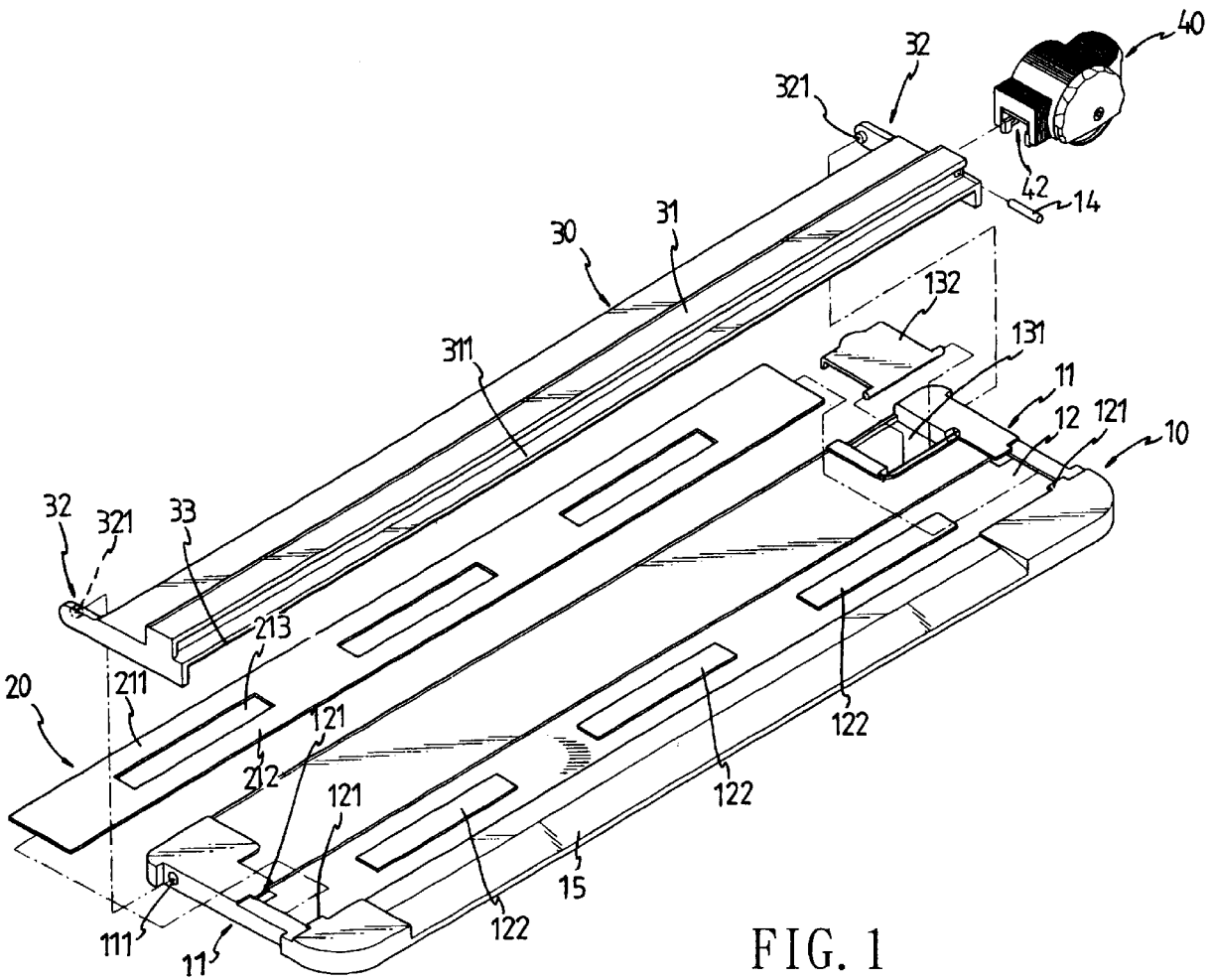
FIG. 1 is an exploded view of a portable precision cutting device in accordance with the present invention.
Figure 2:
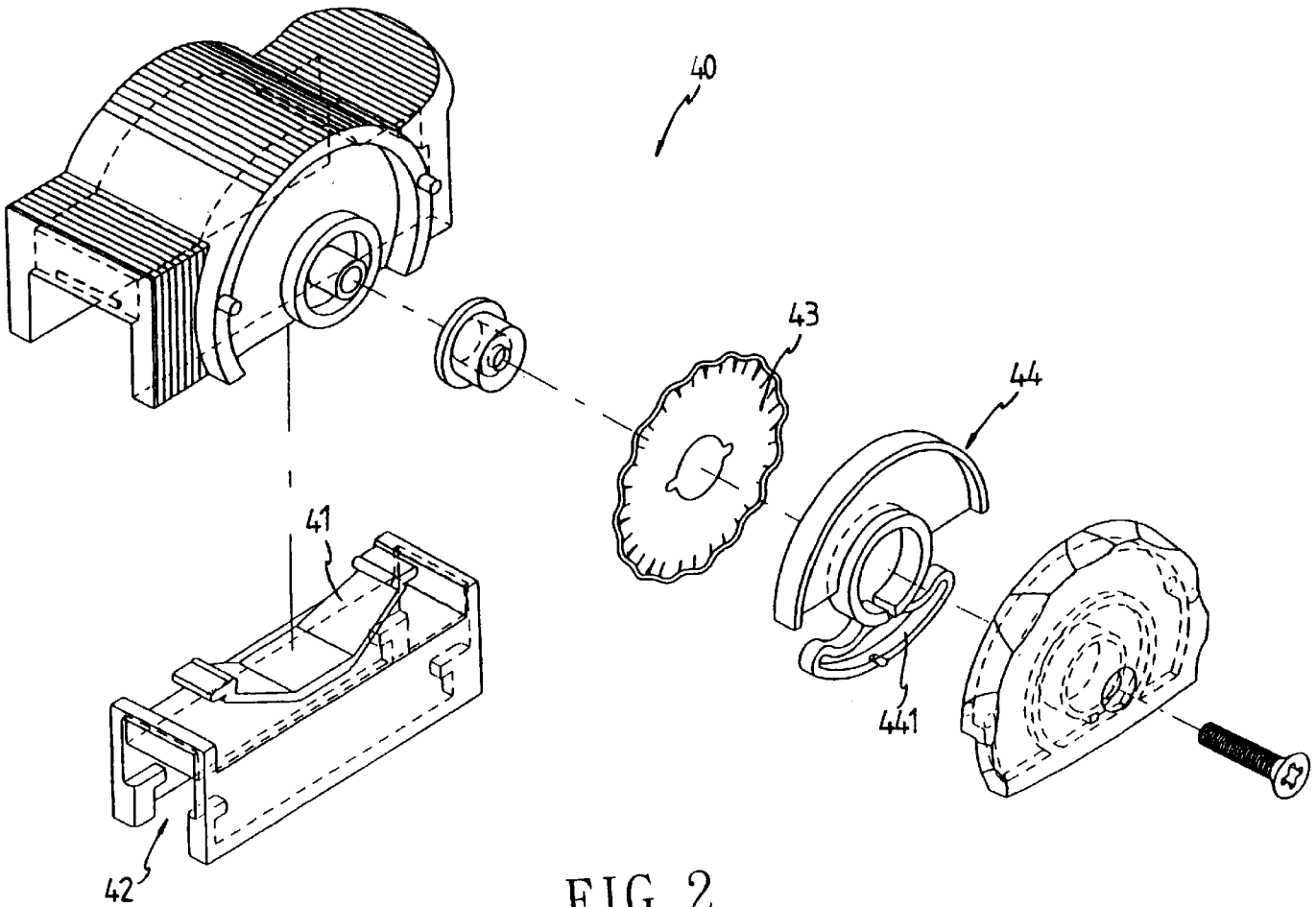
FIG. 2 is an exploded view of a cutting mechanism of the portable precision cutting device in accordance with the present invention.
Figure 3:
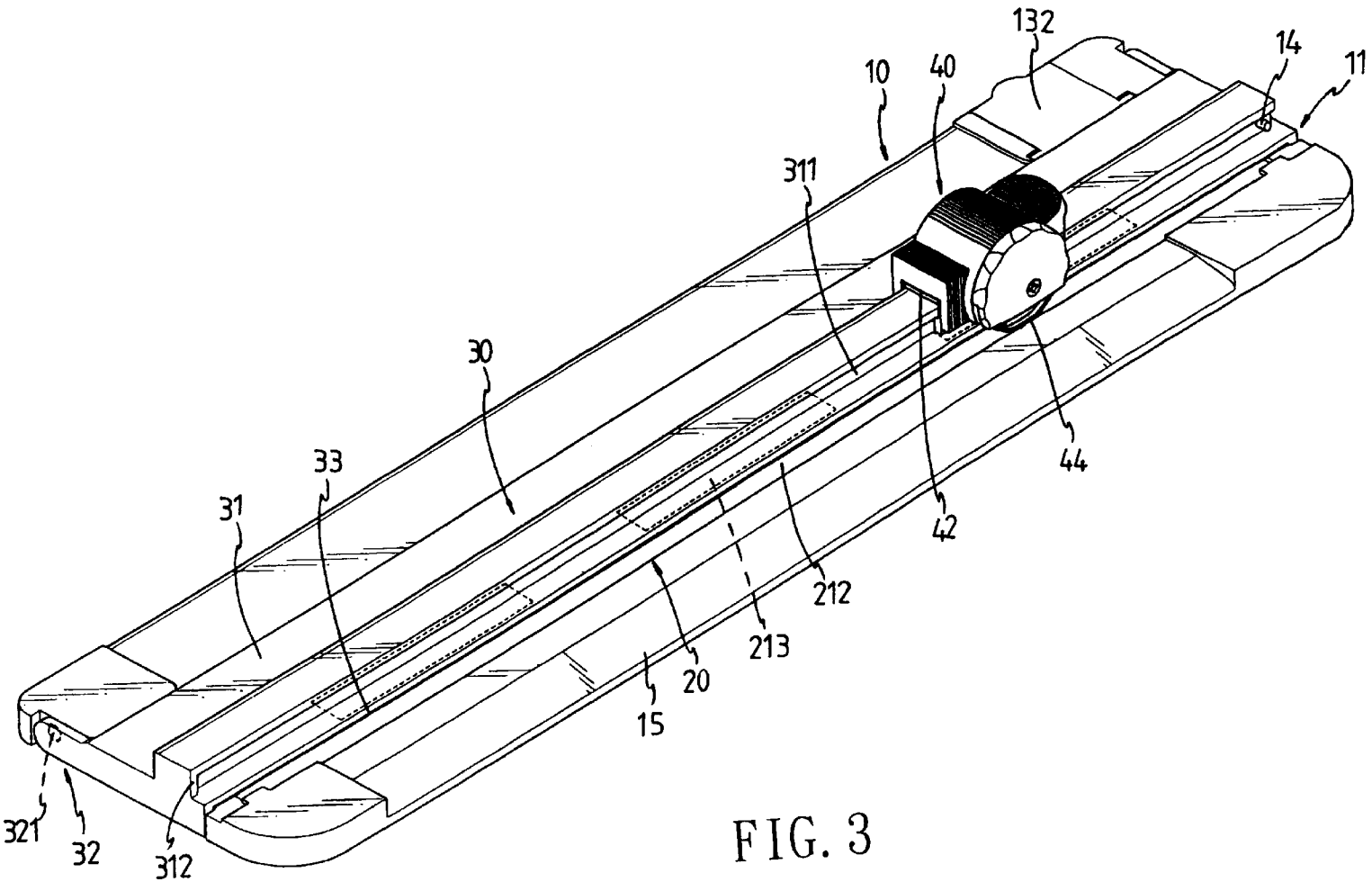
FIG. 3 is a perspective view of a portable precision cutting device in accordance with the present invention.

Referring to FIGS. 1–3, a portable precision cutting device in accordance with the present invention comprises a cutting board 10, a cutting-resistant pad 20, a pressing member 30 and a cutting mechanism 40.

The cutting board 10 includes two mounting portions 11 formed at the both sides respectively, the mounting portions 11 are concavely formed each having a recess 111 formed at the inner side respectively. The cutting board 10 is also provided with a channel 12 formed at the top surface where corresponding to the two mounting portions 11, the channel 12 includes a pair of fasteners 121 disposed at one side and a plurality of magnets 122 disposed at the proper places. Furthermore, a 25 chamber 131 is formed at a predetermined position of the cutting board 10, the same is provided with a cover 132 at the top for an accommodation of some cutting blades, pins or the like.

The cutting-resistant pad 20 made from a kind of cutting-resistant material is formed based on the shape of the channel 12 so as to be accommodated in the channel 12 of the cutting board 10 and can be prevented from moving out by virtue of the fasteners 121. The cutting-resistant pad 20 includes two corresponding cutting portions 211,212 with opposite to each other and a plurality of openings 213 defined therebetween for spacing them apart. It is to be noted that the location of the openings 213 is corresponding to that of the magnets 122 in the channel 12 so that the magnets 122 are permitted to protrude there out.

The pressing member 30 includes a piece of bar 31 and two coupling portions 32 formed at both ends thereof. The coupling portions 32 have two legs 321 formed thereof while the bar 31 have a groove 311 formed at one side. At an end of the grooves 311 is formed a stopping flange 312. The legs 321 in the coupling portion 32 of the pressing member 30 are served to engage with the corresponding recesses 111 in the mounting portions 11 of the cutting board 10 such that the pressing member 30 may be engaged with the cutting board 10 and permitted to do the raising and lowering movement. The pressing member 30 is made from acrylic so as to provide a functional viewing to the operation under of it, moreover, under the bar 31 is adhered a iron sheet 33 for magnetic attraction with the magnets 122 in the channel 12 such that the pressing member 30 is permitted to be fixedly coupled onto the cutting board 10. Certainly, the iron sheet 33 can be thickened or the weight of the pressing member 30 also can be increased if for better attraction.

The cutting mechanism 40 includes an elastic plate 41 and an engaging portion 42 defined on the frame respectively, and includes a roller blade 43 and a shield 44 disposed at a side. A resilient arc portion 441 is formed in the shield 44 where corresponding to the cutting edge of the roller blade 43 for purpose of shielding off the cutting edge of the roller blade 43 (protecting it from cutting the users). The cutting mechanism 40 is movably mounted on the pressing member 30 by virtue of the engaging portion 42 engaged with the bar 31 and the elastic plate 41 resiliently abutting against the same, moreover, a limiting pin 14 can be disposed at an end of the bar 31 for preventing the cutting mechanism 40 from moving out of there (another end of the bar 31 is limited by the stopping flange 312). Such that the pressing member 30 is permitted to do the raising and lowering movement relative to the cutting board 10 and the cutting mechanism 40 may be slide thereon and make a cutting operation when the pressing member 30 is lowed down on the objects.

Figure 4:
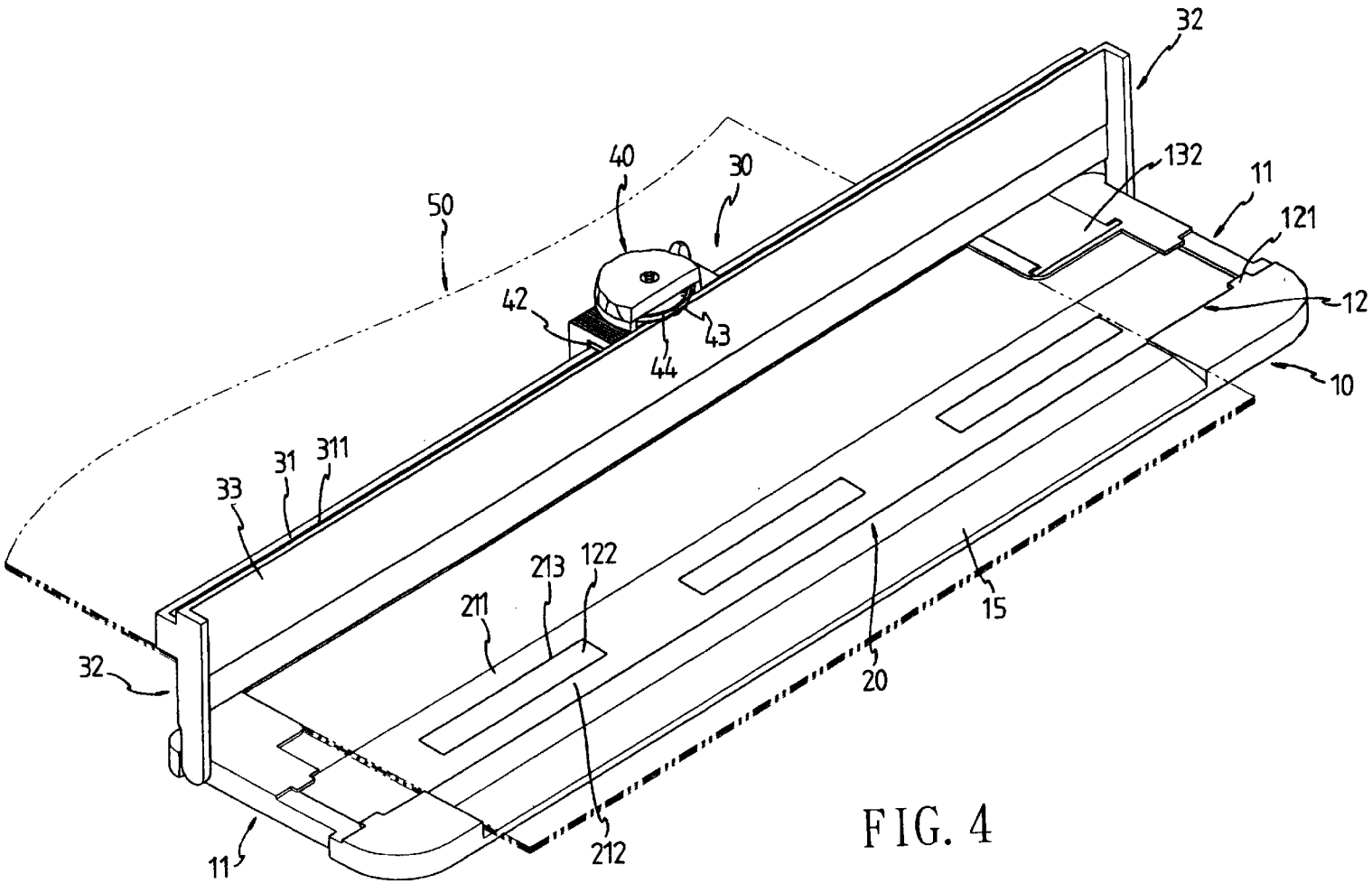
FIG. 4 is a perspective view to show that the pressing member and the cutting mechanism are pivoted relative to the top surface of the cutting board of the portable precision cutting device of the present invention.
Figure 5:
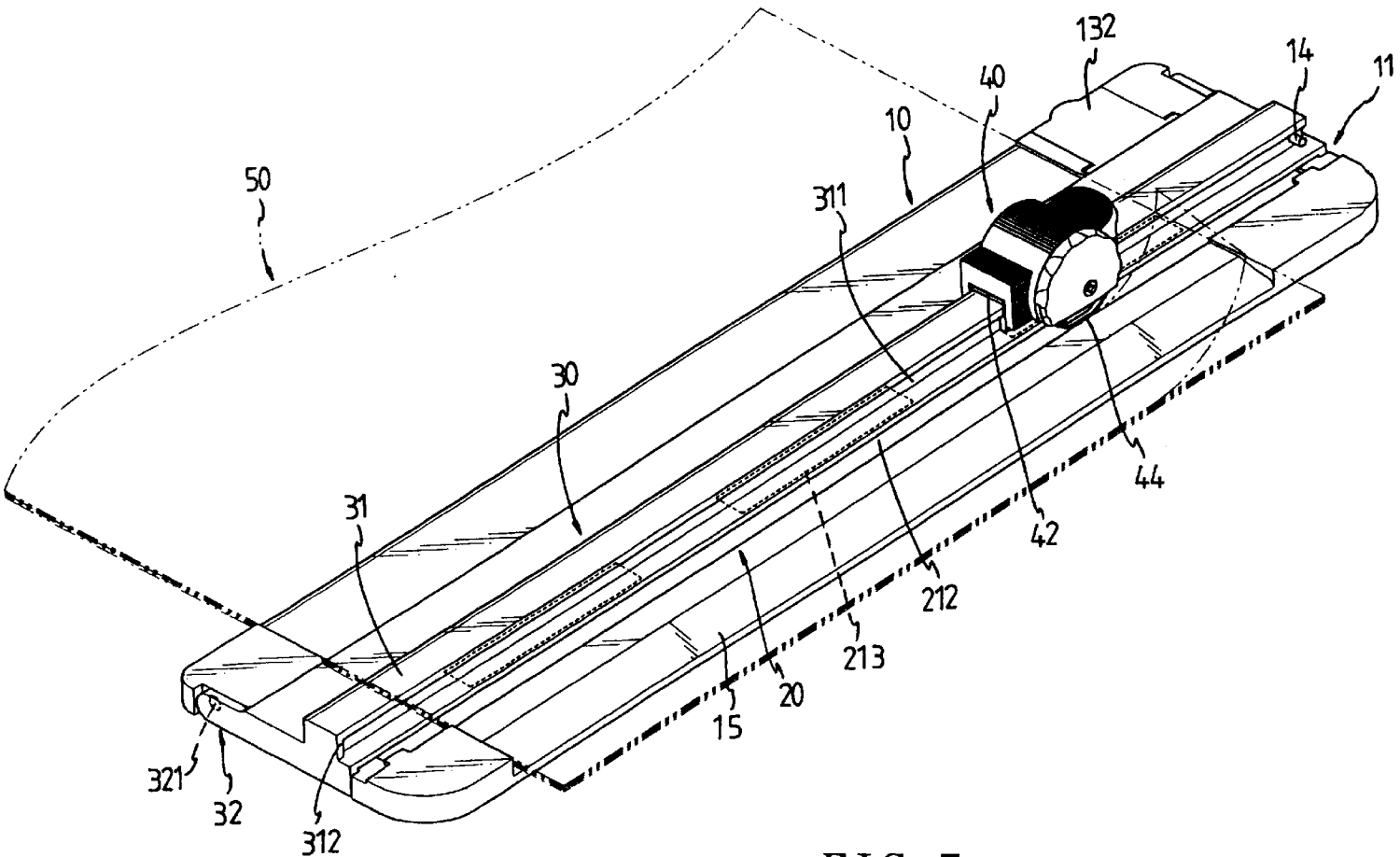
FIG. 5 is a perspective view to show the cutting mechanism cuts the sheets.

In term of operation sequence, initially the pressing member 30 can be raised (as shown in FIG. 4) to defined a distance between the bar 31 and the cutting board 10 so as to allow an insertion of piles of objects 50 (such as sheets), then low the pressing member 30 down with the bottom of it compressing against the objects 50 (as shown FIG. 5) so that the roller blade 43 of the cutting mechanism 40 is allowed to face toward the objects 50, then followed by slightly pressing the cutting mechanism 40 causing a downward deformation of the elastic plate 41 and so of the resilient arc portion 441, such that the cutting edge of the roller blade 43 is permitted to touch the objects 60. As a result, the cutting operation can be done just by pushing the cutting mechanism 40 to move back and forth along the bar 31 (as shown in FIG. 5).

It is to be noted that the cutting operation of the present invention on the sheets 50 is made by virtue of the sharp roller blade 43 of the cutting mechanism 40, furthermore, the cutting mechanism 40 may be linearly move along the bar 31 back and forth, thereby, the cutting edge of the sheets 50 will not be rough after cut (because of the sharp roller blade 43) and the cutting line will be linear and precise (due to the compressive force and guidance of the bar 31), viz. the portable precision cutting device is able to provide a perfect and precise cutting operation.

In term of safety, the cutting mechanism 40 of the present invention is no need to be raised to a high extent during operation and the roller blade 43 of the cutting mechanism 40 is shielded off by the shield 44, so it is much safer than the conventional cutting device.

Figure 6:
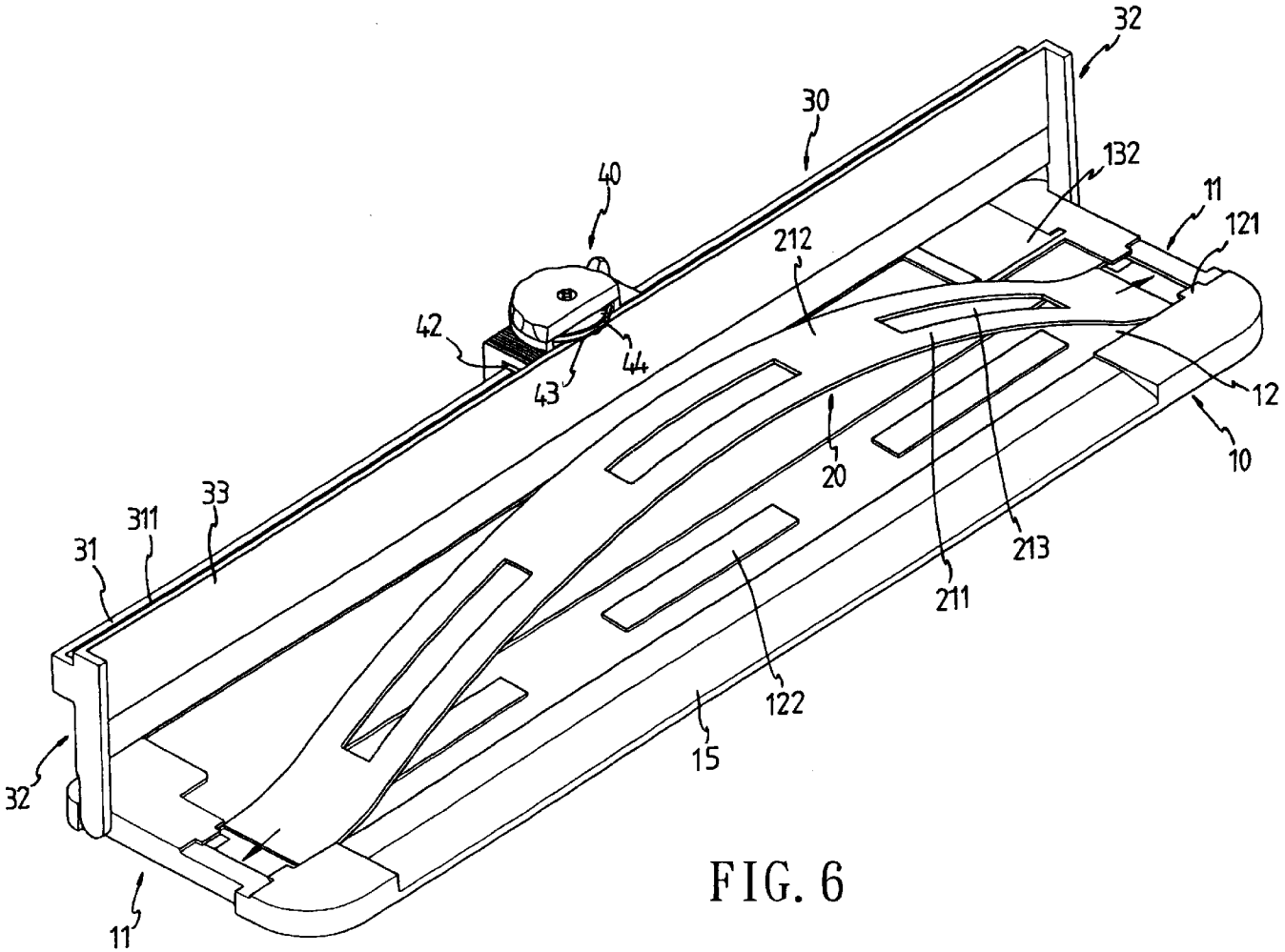
FIG. 6 is a perspective view in accordance with the present invention of showing a cutting-resistant pad being lifted up from the cutting board.

On the other hand, the cutting-resistant pad 20 of the present invention can be received in the channel 12 of the cutting board 10 with one of the cutting portions 211, 212 corresponding to the roller blade 43. Thereby, when one of the cutting portions 211,212 is worn off after a long time of operation, the cutting-resistant pad 20 can be turned over or upside down (as shown in FIG. 6) so that all sides of the cutting portion 211,212 are permitted to be used (four sides in total).

Please to be noted that a side of the cutting board 10 is preferably in form of an inclined surface 15 for allowing the leftover bits and pieces of the sheets 50 to slide out therefrom automatically (as shown in FIG. 5).

While we have shown and described various embodiments in accordance with the present invention, it should be clear to those skilled in the art that further embodiment may be made without departing from the scope of the present invention.

What is claimed is:

1. A portable precision cutting device comprising:

a cutting board, at both sides of which is formed with a mounting portion, each mounting portion being concavely formed, and at an inner side of the each mounting portion being defined with a recess, a channel formed at a top surface corresponding to the two mounting portions, in the channel being provided with plural magnets;

a cutting-resistant pad formed in accordance with the shape of the channel so as to be accommodated in the channel of the cutting board, and plural fasteners serving to prevent disengagement of the cutting-resistant pad from the channel, the cutting-resistant pad including two cutting portions and spaced apart by a plurality of openings defined therebetween, the openings being located corresponding to the magnets;

a pressing member including a piece of bar and two coupling portions formed at both sides thereof, the two coupling portions having legs formed thereof while the bar having a groove formed at one side, the legs in the coupling portion of the pressing member serving to engage with the corresponding recesses in the mounting portions of the cutting board, whereby the pressing member can be engaged with the cutting board for raising and lowering movement, under the bar adhered an iron sheet for magnetic attraction with the magnets in the channel;

a cutting mechanism provided on its frame with an elastic plate and an engaging portion respectively, a roller blade and a shield disposed at a side of the cutting mechanism, the cutting mechanism movably mounted on the pressing member by virtue of the engaging portion engaged with the bar, and the elastic plate employed to resiliently abut against the bar, a limiting pin preferably disposed at an end of the bar of the pressing member for preventing disengagement of the cutting mechanism from the bar.

2. The portable precision cutting device as claimed in claim 1, wherein a chamber is formed at a predetermined position of the cutting board for an accommodation of some cutting blades, pins or the like, at top of the chamber is provided with a cover.

3. The portable precision cutting device as claimed in claim 1, wherein a resilient arc portion is formed in the shield in corresponding to cutting edge of the roller blade for purpose of shielding off the cutting edge of the roller blade.

4. The portable precision cutting device as claimed in claim 1, wherein an edge of the cutting board is preferably in form of an inclined surface for allowing leftover bits of paper sheets to slide out automatically.

5. The portable precision cutting device as claimed in claim 1, wherein a stopping flange is formed at an end of the bar and a limiting pin is disposed at another end of the bar for limiting movement of the cutting mechanism.

* * * * *